US010283046B2

(12) United States Patent
Yamamura

(10) Patent No.: US 10,283,046 B2
(45) Date of Patent: May 7, 2019

(54) ELECTRO-OPTICAL DEVICE, DRIVING METHOD FOR ELECTRO-OPTICAL DEVICE, AND ELECTRONIC APPARATUS

(71) Applicant: SEIKO EPSON CORPORATION, Tokyo (JP)

(72) Inventor: Kuni Yamamura, Chino (JP)

(73) Assignee: SEIKO EPSON CORPORATION, Tokyo (JP)

( * ) Notice: Subject to any disclaimer, the term of this patent is extended or adjusted under 35 U.S.C. 154(b) by 0 days.

(21) Appl. No.: 15/612,488

(22) Filed: Jun. 2, 2017

(65) Prior Publication Data

US 2017/0372657 A1 Dec. 28, 2017

(30) Foreign Application Priority Data

Jun. 23, 2016 (JP) ..... 2016-124228

(51) Int. Cl.
*G09G 3/3233* (2016.01)
*G09G 3/3266* (2016.01)
(Continued)

(52) U.S. Cl.
CPC ..... *G09G 3/3233* (2013.01); *G09G 3/3266* (2013.01); *G09G 3/3275* (2013.01);
(Continued)

(58) Field of Classification Search
CPC .. G09G 3/3233; G09G 3/3275; G09G 3/3266; G09G 2320/0247; G09G 3/3291; G09G 2300/0861; G09G 2300/0852; G09G 2300/0842; G09G 2300/0819; G09G 2320/064; G09G 2320/0214; G09G 2320/041
See application file for complete search history.

(56) References Cited

U.S. PATENT DOCUMENTS 6,008,929 A * 12/1999 Akimoto ..... G09G 3/3406 345/102
8,237,687 B2 * 8/2012 Koyama ..... H01L 51/5253 345/204
(Continued)

FOREIGN PATENT DOCUMENTS

JP 2009-025413 A 2/2009
JP 2011-053438 A 3/2011
JP 2012-053447 A 3/2012

*Primary Examiner* — Jose R Soto Lopez
(74) *Attorney, Agent, or Firm* — Oliff PLC

(57) ABSTRACT

An electro-optical device includes a driving transistor in which a source, a light emission control transistor in which the source is connected to a drain of the driving transistor, an OLED element in which one end is connected to the drain of the light emission control transistor, and a first holding capacitor in which one end is connected to a gate of the driving transistor, the other end is connected to the drain of the driving transistor, and holds a potential that corresponds to a potential of a data signal of a designated tone, in which a driving circuit is provided with a non-light emission period of the OLED element per predetermined period in one vertical scanning period, and monotonically decreases a proportion of the non-light emission period in the predetermined period by controlling the light emission control transistor.

5 Claims, 11 Drawing Sheets

(51) Int. Cl.
*G09G 3/3275* (2016.01)
*G09G 3/3291* (2016.01)

(52) U.S. Cl.
CPC ... *G09G 3/3291* (2013.01); *G09G 2300/0819* (2013.01); *G09G 2300/0842* (2013.01); *G09G 2300/0852* (2013.01); *G09G 2300/0861* (2013.01); *G09G 2320/0214* (2013.01); *G09G 2320/0247* (2013.01); *G09G 2320/041* (2013.01); *G09G 2320/064* (2013.01)

(56) References Cited

U.S. PATENT DOCUMENTS 9,401,108 B2 * 7/2016 Park ..... G09G 3/20
10,115,346 B2 * 10/2018 Maeyama ..... G09G 3/30
2002/0036610 A1 * 3/2002 Ito ..... G09G 3/20 345/89
2002/0135312 A1 * 9/2002 Koyama ..... G09G 3/3225 315/169.3
2004/0263503 A1 * 12/2004 Seki ..... G09G 3/3233 345/204
2005/0134532 A1 * 6/2005 Choi ..... G09G 3/288 345/60
2007/0085779 A1 * 4/2007 Smith ..... G09G 3/3216 345/76
2007/0262935 A1 * 11/2007 Shin ..... G09G 3/3291 345/84
2008/0218453 A1 * 9/2008 Miyamoto ..... G09G 3/3233 345/76
2008/0231622 A1 * 9/2008 Honda ..... G09G 3/3648 345/211
2009/0128883 A1 * 5/2009 Endo ..... G02B 26/0841 359/290
2009/0219226 A1 * 9/2009 Yahagi ..... G09G 3/2022 345/60
2012/0033000 A1 2/2012 Takahashi et al.
2012/0075363 A1 * 3/2012 Kim ..... G09G 3/2022 345/691
2012/0293479 A1 * 11/2012 Han ..... G09G 3/003 345/212
2013/0222352 A1 * 8/2013 Jeong ..... G09G 3/3266 345/205
2014/0085322 A1 * 3/2014 Lee ..... G09G 5/18 345/545
2014/0139503 A1 * 5/2014 Han ..... G09G 3/3291 345/212
2014/0300592 A1 * 10/2014 Lee ..... G09G 3/3233 345/212
2015/0187254 A1 * 7/2015 Lee ..... G09G 3/2022 345/692
2016/0321993 A1 * 11/2016 Choi ..... G09G 3/3258
2016/0329393 A1 * 11/2016 Seo, II ..... H01L 27/3262
2016/0358531 A1 * 12/2016 Nakakita ..... G09G 3/3233
2017/0345376 A1 * 11/2017 Tani ..... G09G 3/3233

* cited by examiner

ELECTRO-OPTICAL DEVICE, DRIVING METHOD FOR ELECTRO-OPTICAL DEVICE, AND ELECTRONIC APPARATUS

BACKGROUND

1. Technical Field

The present invention relates to an electro-optical device, a driving method for an electro-optical device, and an electronic apparatus.

2. Related Art

In recent years, various electro-optical devices are suggested that use a light emitting element such as an organic light emitting diode element (hereinafter referred to as "OLED") that is referred to as an organic electro luminescent (EL) element, a light emitting polymer element, or the like (for example, refer to JP-A-2009-25413).

The electro-optical device in JP-A-2009-25413 is provided with an OLED element, a driving transistor, a light emission control transistor, and a switching element in a pixel circuit. The electro-optical device in JP-A-2009-25413 outputs potential of image data according to a designated tone of the OLED element to a data line in a writing period. At this time, since the switching element is set to the on state, the potential of the image data is written to a holding capacitor via the switching element. In a light emission period after the writing period of the image data, the switching element is set to the off state, and the driving transistor and the light emission control transistor are set to the on state. Thereby, electric charge that is accumulated in the holding capacitor flows to the OLED element via the driving transistor and the light emission control transistor, and the OLED element emits light.

In the technology in JP-A-2009-25413, current leakage from the holding capacitor may be generated, and flicker is generated by reducing light emission intensity of the OLED element in one vertical scanning period.

SUMMARY

An advantage of some aspects of the invention is to provide an electro-optical device that is able to reduce flicker caused by current leakage from a holding capacitor, a driving method for an electro-optical device, and an electronic apparatus.

According to an aspect of the invention there is provided an electro-optical device including a first conductive layer that extends in a first direction, a second conductive layer that extends in a second direction that intersects with the first direction, a pixel circuit that is arranged to correspond to intersection of each of the first conductive layer and the second conductive layer, and a driving circuit that drives the pixel circuit, in which the pixel circuit includes a light emitting element in which one end is connected to a second power source layer, a driving transistor in which a source or a drain is connected to a first power source layer, a source or a drain other than the source or the drain that is connected to the first power source layer is directly or indirectly connected to another end of the light emitting element, and generates a driving current with respect to the light emitting element, and a first holding capacitor in which one end is connected to a gate of the driving transistor, the other end is connected to the source or the drain of the driving transistor, and holds a potential that corresponds to a potential of a data signal of a designated tone, and in which the driving circuit is provided with a non-light emission period of the light emitting element per predetermined period in one vertical scanning period, and monotonically decreases a proportion of the non-light emission period in the predetermined period.

In the aspect, the non-light emission period of the light emitting element is provided in each predetermined period in one vertical scanning period, and the proportion of the non-light emission period in the predetermined period is monotonically decreased. In other words, the proportion of the light emission period in the predetermined period is monotonically increased. Accordingly, even in a case where actual luminance of the light emitting element is monotonically decreased in one vertical scanning period caused by leakage current from the first holding capacitor, luminance that is apparent in a value in which the actual luminance is multiplied by the ratio of light emission time to the predetermined period is averaged. As a result, it is possible to reduce the difference of luminance that is apparent between the beginning and the end of one vertical scanning period, and reduce flicker.

In the aspect, the driving circuit may be provided with an adjustment portion that adjusts a length of the non-light emission period in the predetermined period according to an operation of a user. According to the aspect of the invention, even if a degree of monotonic decrease of the actual luminance is different, it is possible to adjust the length of the non-light emission period while confirming a flicker state. Accordingly, even in a case where characteristics and the like of individual first holding capacitors are different, flicker is appropriately reduced.

In the aspect, a temperature detecting portion that detects a temperature of the pixel circuit may be provided, and the driving circuit may change a proportion of the non-light emission period in the predetermined period according to the temperature that is detected by the temperature detecting portion. According to the aspect, even in a case where leakage current from the first holding capacitor is changed according to a change of the temperature, and the degree of monotonic decrease of the actual luminance is different, the length of the non-light emission period is determined according to the detected temperature. As a result, according to the temperature change, it is possible to average luminance that is apparent per unit time, and it is possible to reduce flicker.

According to another aspect of the invention there is provided a driving method for an electro-optical device including a first conductive layer that extends in a first direction, a second conductive layer that extends in a second direction that intersects with the first direction, a pixel circuit that is arranged to correspond to intersection of each of the first conductive layer and the second conductive layer, and a driving circuit that drives the pixel circuit, in which the pixel circuit includes a light emitting element in which one end is connected to a second power source layer, a driving transistor in which a source or a drain is connected to a first power source layer, a source or a drain other than the source or the drain that is connected to the first power source layer is directly or indirectly connected to another end of the light emitting element, and generates a driving current with respect to the light emitting element, and a first holding capacitor in which one end is connected to a gate of the driving transistor, the other end is connected to the source or the drain of the driving transistor, and holds a potential that corresponds to a potential of a data signal of a designated tone, in which a non-light emission period of the light emitting element is provided per predetermined period in one vertical scanning period, and a proportion of the non-light emission period is monotonically decreased in the predetermined period. The same effects are also obtained in the driving method described above as in the electro-optical device according to the aspects of the invention.

According to still another aspect of the invention, there is provided an electronic apparatus including the electro-optical device described above. Such an electronic apparatus is able to display an image with high quality with little flicker.

BRIEF DESCRIPTION OF THE DRAWINGS

The invention will be described with reference to the accompanying drawings, wherein like numbers reference like elements.

DESCRIPTION OF EXEMPLARY EMBODIMENTS

A: First Embodiment

Figure 1:
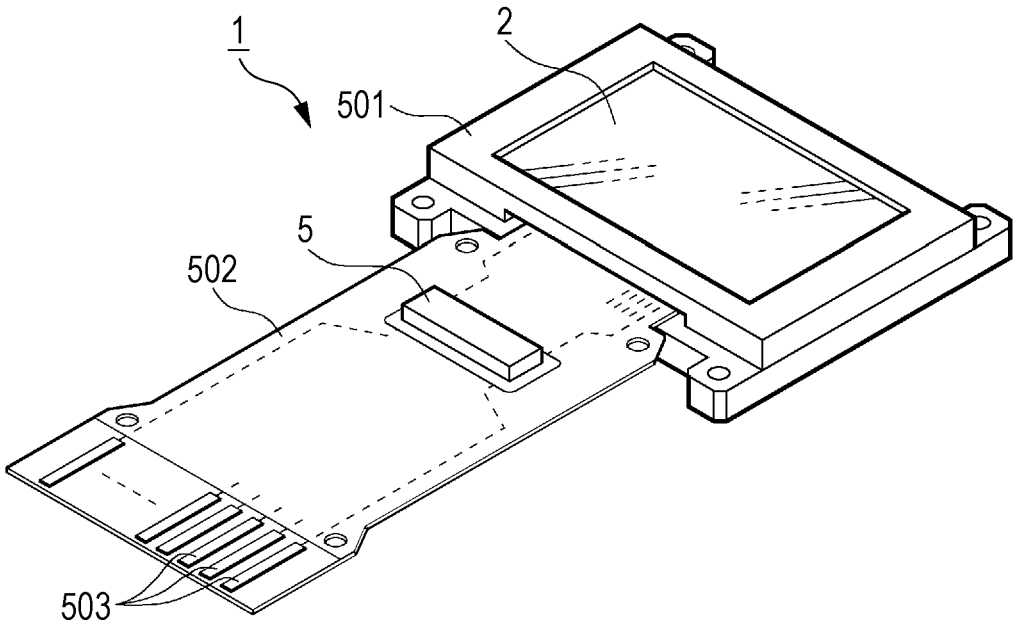
FIG. 1 is a perspective view illustrating a configuration of an electro-optical device according to a first embodiment of the invention.

FIG. 1 is a perspective view illustrating a configuration of an electro-optical device 1 according to a first embodiment of the invention. The electro-optical device 1 is provided with a display panel 2 that displays an image and a control portion 5 that controls an operation of the display panel 2.

The display panel 2 is provided with a plurality of pixel circuits and a driving circuit that drives the pixel circuits. In the embodiment, the plurality of pixel circuits and driving circuits that the display panel 2 is provided with are formed on a silicon substrate, and an OLED is used that is an example of a light emitting element on the pixel circuits. In addition, for example, the display panel 2 is accommodated in a frame shape casing 501 that is open in a display portion, and is connected to one end of a flexible printed circuit (FPC) substrate 502. The control portion 5 of a semiconductor chip is mounted on the FPC substrate 502 using a chip on film (COF) technique, a plurality of terminals 503 are provided, and are connected to an upper circuit that is omitted from the drawings.

Figure 2:
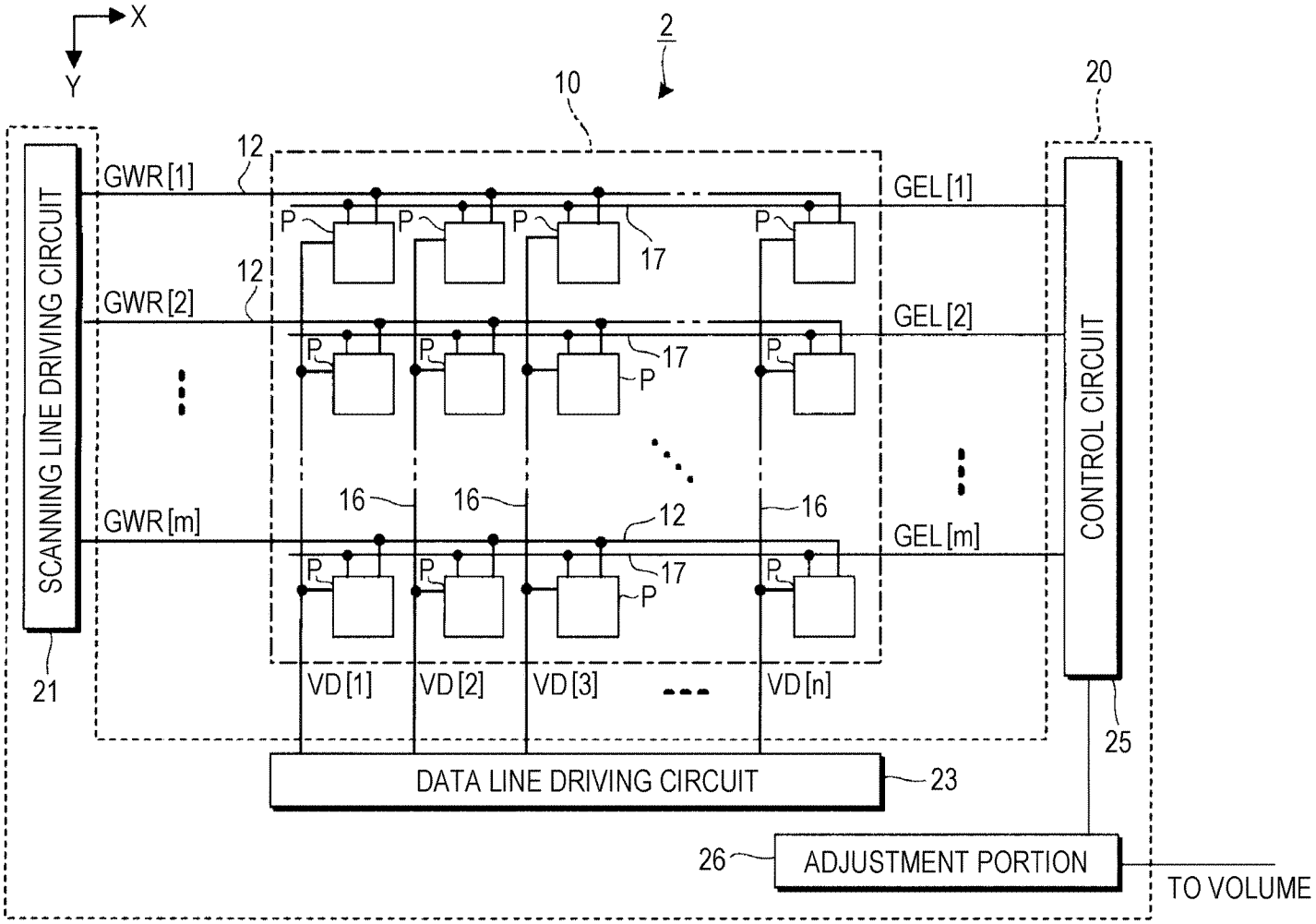
FIG. 2 is a block diagram of a display panel.

FIG. 2 is a block diagram illustrating a schematic configuration of the display panel 2. As shown in FIG. 2, the display panel 2 is equipped with an element portion 10 in which a plurality of pixel circuits P are arranged, and a driving circuit 20 that drives each pixel circuit P. The driving circuit 20 is configured to include a scanning line driving circuit 21, a data line driving circuit 23, and a control circuit 25. For example, the driving circuit 20 is mounted to disperse to a plurality of integrated circuits. However, at least a part of the driving circuit 20 is able to be constituted by the pixel circuits P and a thin film transistor that is formed on the substrate.

m scanning lines 12 as a first conductive layer that extends in the X direction as a first direction and n data lines 16 as a second conductive layer that extends in the Y direction as a second direction which intersects with the X direction are formed in the element portion 10 (m and n are natural numbers). The plurality of pixel circuits P are disposed to intersect with the scanning lines 12 and the data lines 16, in a matrix of vertically arranged m rows by horizontally arranged n columns. The scanning line driving circuit 21 outputs scanning signals GWR[1] to GWR[m] to each scanning line 12. The data line driving circuit 23 outputs data signals VD[1] to VD[n] of image data to each data line 16 according to tone that is designated in each pixel circuit P (hereinafter referred to as "designated tone").

The control circuit 25 outputs control signals GEL[1] to GEL[m] to a light emission control transistor 124 which will be described later. Details will be given later.

Figure 3:
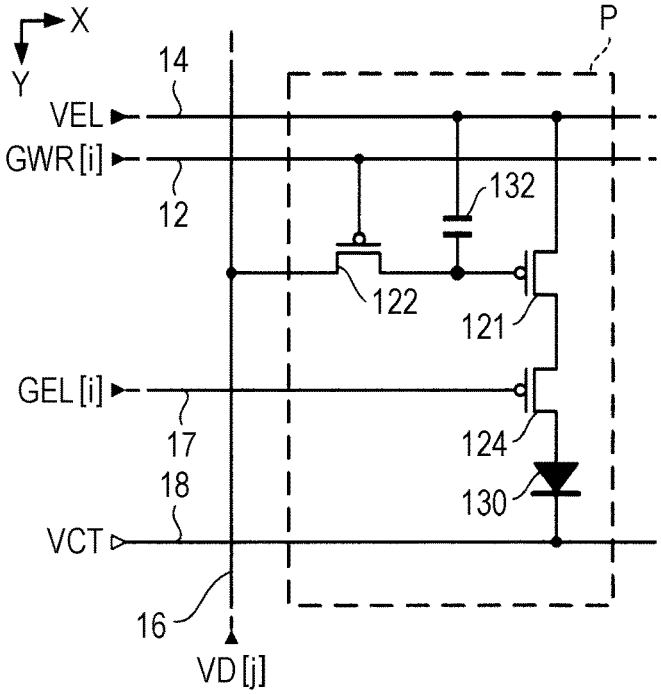
FIG. 3 is a circuit diagram of a pixel circuit.

FIG. 3 is a circuit diagram of a pixel circuit P. Since the pixel circuits P have the same electrical configuration as each other, here, the pixel circuit P that is positioned at m rows and n columns is described as an example. As shown in FIG. 3, the pixel circuit P is provided with a P channel MOS type driving transistor 121, a P channel MOS type selection transistor 122, and a P channel MOS type light emission control transistor 124. In addition, the pixel circuit P is provided with an OLED element 130 as the light emitting element, and a holding capacitor 132.

In the selection transistor 122, the gate is electrically connected to the scanning line 12 of the $m^{th}$ row, and one of the source or the drain are electrically connected to the data line 16 of the $n^{th}$ column. In addition, the other of the source or the drain of the selection transistor 122 is respectively electrically connected to the gate of the driving transistor 121 and one end of the holding capacitor 132. In addition, the scanning signal GWR[m] is supplied to the gate of the selection transistor 122 from the scanning line driving circuit 21 via the scanning line 12 of the $m^{th}$ row. That is, the selection transistor 122 is electrically connected between the gate of the driving transistor 121 and the data lines 16, and controls electrical connection between the gate of the driving transistor 121 and the data lines 16.

The driving transistor 121 is respectively electrically connected at the source to a first power supply line 14 as a first power source layer and at the drain to the source of the light emission control transistor 124. Here, a power source voltage VEL that is at a high potential side in the pixel circuit P is supplied to the first power supply line 14. The driving transistor 121 supplies current according to the voltage between the gate and the source of the driving transistor 121 to the OLED element 130 via the light emission control transistor 124.

Since the display panel 2 is formed on a silicon substrate in the embodiment, a substrate potential of the driving transistor 121 and the selection transistor 122 is set as the power source voltage VEL. Note that, the source and the drain of the driving transistor 121 and the selection transistor 122 described above may be replaced according to the channel type or potential relationship of the driving transistor 121 and the selection transistor 122. In addition, the transistor may be a thin film transistor or a field effect transistor.

In addition, in the light emission control transistor 124, the source is electrically connected to the drain of the driving transistor 121 and the drain is electrically connected to an anode of the OLED element 130. The control signal GEL[m] is supplied to the gate of the light emission control transistor 124 from the control circuit 25 via a control line 17. The light emission control transistor 124 is connected between the driving transistor 121 and the OLED element 130, and switches between the light emission period and the non-light emission period of the OLED element 130.

The anode of the OLED element 130 is a pixel electrode individually provided in each pixel circuit P. In contrast to this, a cathode of the OLED element 130 is connected to a common second power supply line 18 as a second power source layer over the pixel circuits P in each row.

The OLED element 130 is an element that interposes a white organic EL layer using the anode and the cathode that has light transmittance of the OLED element 130 on the silicon substrate. Then, a color filter that corresponds to any of RGB overlaps on an emission side (cathode side) of the OLED element 130.

In such an OLED element 130, when current flows from the anode to the cathode, an exciton is generated by recombining a positive hole that is injected from the anode and an electron that is injected from the cathode using the organic EL layer, and white light is emitted. There is configuration in which white light generated at this time passes through the cathode on the opposite side from the silicon substrate (anode), and is observed at the observer side through coloring using the color filter.

In the holding capacitor 132 as the first holding capacitor, one end is electrically connected to the gate of the driving transistor 121 and the other end is electrically connected to the first power supply line 14. Accordingly, while the selection transistor 122 is off, the voltage between the gate and the source of the driving transistor 121 is maintained at a constant value by the holding capacitor 132.

Figure 4:
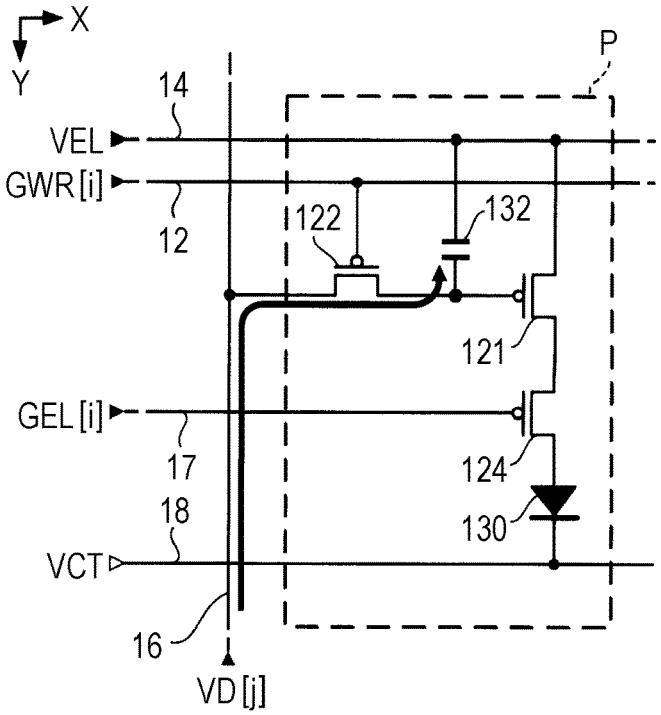
FIG. 4 is a diagram for describing an operation of the pixel circuit.

In more detail, as shown in FIG. 4, the selection transistor 122 is turned on in a horizontal scanning period in which the scanning line driving circuit 21 scans the scanning line 12 of the $m^{th}$ row, and a data signal VD[n] is supplied to a gate node of the driving transistor 121. FIG. 4 is a diagram for describing an operation of the pixel circuit P in a writing period. In this manner, in the embodiment, in the writing period, the selection transistor 122 is set to the on state, and the data signal VD[n] that is image data is output to the gate node of the driving transistor 121.

Figure 5:
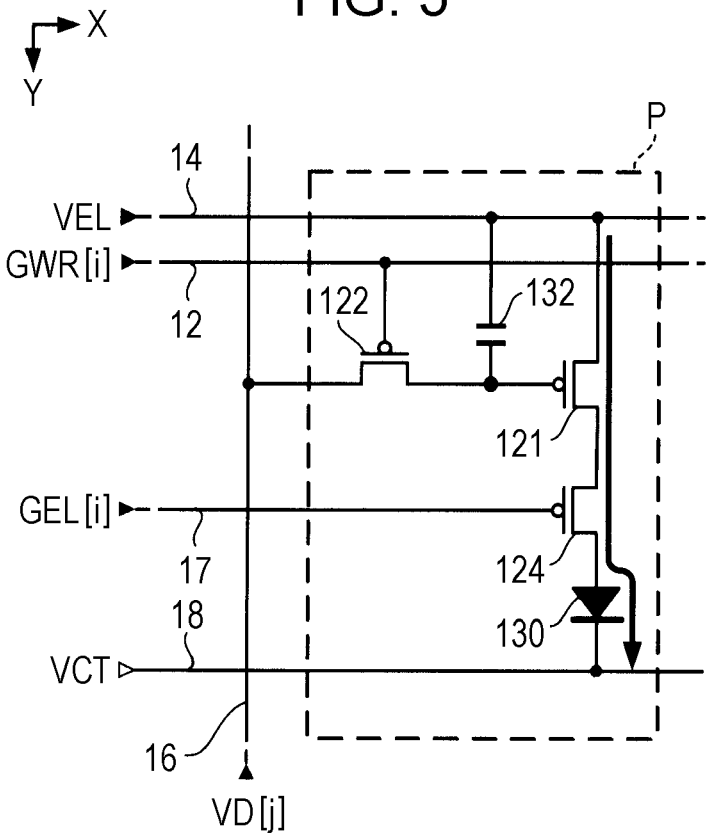
FIG. 5 is a diagram for describing an operation of the pixel circuit.

After that, when the selection transistor 122 is set to off, the potential of the gate node of the driving transistor 121 is maintained at a potential that is indicated in the data signal VD[n] by the holding capacitor 132. Here, as shown in FIG. 5, when the light emission control transistor 124 is on, the current is supplied to the OLED element 130 according to the potential between the gate and source of the driving transistor 121. FIG. 5 is a diagram for describing an operation of the pixel circuit P in the light emission period. In this manner, in the period in which the light emission control transistor 124 is on, the OLED element 130 emits light according to the supplied current. That is, the period in which the light emission control transistor 124 is on is the light emission period of the OLED element 130.

In the light emission period, the OLED element 130 displays the tone that is specified in the data signal VD[n]. Note that, as the holding capacitor 132, a capacitor that is parasitic on the gate node of the driving transistor 121 may be used, and a capacitor that is formed by interposing an insulation layer with conductive layers that are different from each other on the silicon substrate may be used.

Meanwhile, when the light emission control transistor 124 is off, the current from the driving transistor 121 is not supplied to the OLED element 130, and the OLED element 130 is set to a non-light emission state. That is, the period in which the light emission control transistor 124 is off is the non-light emission period of the OLED element 130.

Figure 6:
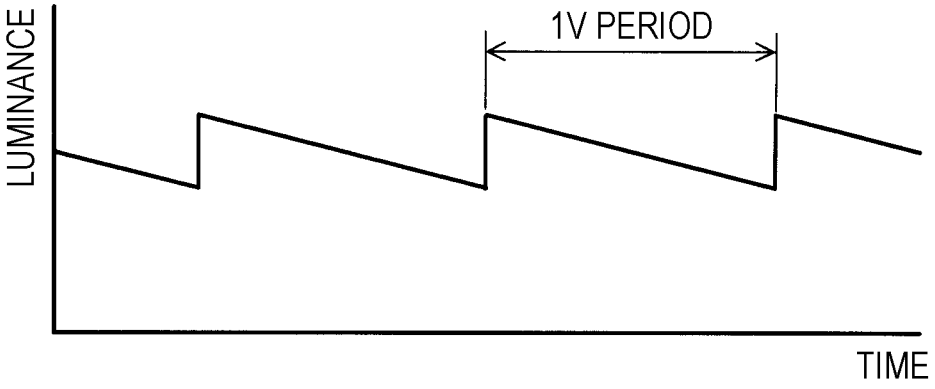
FIG. 6 is a diagram illustrating an output waveform of a luminance meter at an arbitrary measurement point when a half tone image is displayed on a display panel in a comparative example.

If it is assumed that the light emission control transistor 124 is always set to on from the selection transistor 122 being in the off state until the selection transistor 122 is switched on again after one frame period (one vertical scanning period) elapses. In this case, one frame period is set to the light emission period of the entire OLED element 130. However, the current gradually leaks from the holding capacitor 132 in the one frame period, and the potential of the holding capacitor 132 is reduced. FIG. 6 is a diagram illustrating that luminance at an arbitrary measurement point is measured by a luminance meter and illustrating an output waveform of the luminance meter that is displayed on an oscilloscope when a half tone image is displayed on the display panel 2 in a comparative example. As shown in FIG. 6, the luminance of the pixels is understood to monotonically decrease in each period of one frame (1V). Then, a luminance difference of initial luminance of the one frame period and final luminance of the one frame period is recognized as flicker.

Apparent luminance of an object that flashes at a frequency of approximately 10 Hz or more due to Talbot's law is known to be equal to a value of the ratio of irradiation time to total time multiplied by the actual luminance. Accordingly, in a case where the actual luminance is temporally changed, in order to reduce the apparent luminance difference, it is understood that the lower the actual luminance the more the irradiation time with respect to the total time is increased.

Therefore, in the embodiment, there is a configuration in which the OLED element 130 does not emit light in the entire period of one frame, the light emission period and the non-light emission period are provided in the predetermined period, and the proportion of the light emission period in the predetermined period is monotonically increased corresponding to monotonic decrease of luminance. In other words, there is a configuration in which the proportion of the non-light emission period in the predetermined period is monotonically decreased.

Figure 7:
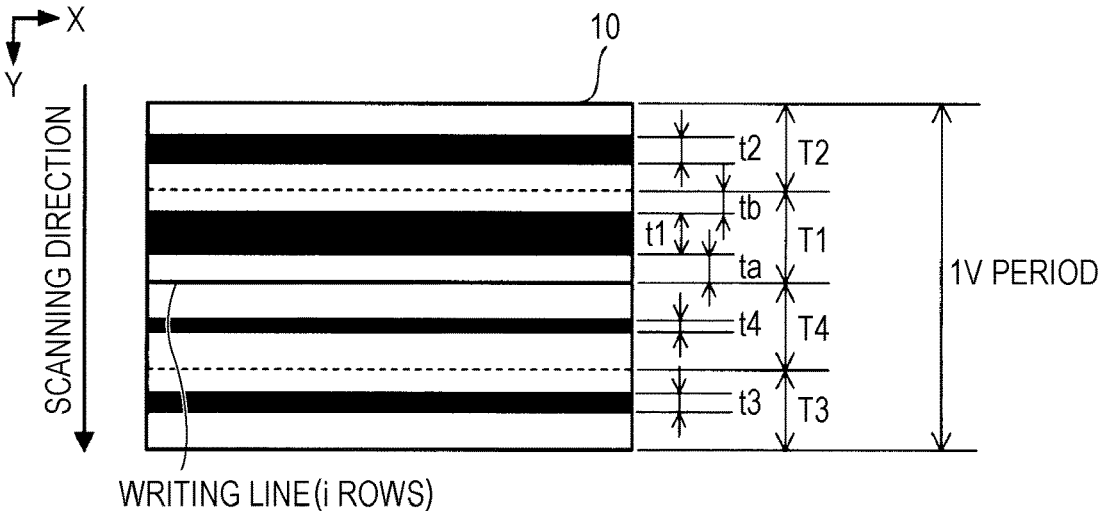
FIG. 7 is a diagram illustrating a non-light emission period in each predetermined period in the first embodiment.

As shown in FIG. 7, for example, one frame period (1V period) is divided into a first period T1, a second period T2, a third period T3, and a fourth period T4, and the proportion of the non-light emission period in each period is monotonically decreased. For example, FIG. 7 illustrates a case where a data signal VD is output to the gate node of the driving transistor 121 of the pixel circuit P that corresponds to the scanning line 12 of the $i^{th}$ row, and the scanning line 12 is the written line. In this case, the first period T1 starts from the start of the writing period in the pixel circuit P of the 1st column that corresponds to the written line. A period ta from the start of the first period T1 is the light emission period in which the OLED element 130 of the pixel circuit P that corresponds to the written line emits light. That is, the light emission control transistor 124 of the pixel circuit P is on in the period ta. When the period ta from the start of the first period T1 elapses, the period t1 thereafter is the non-light emission period in which the OLED element 130 of the pixel circuit P does not emit light. That is, the light emission control transistor 124 of the pixel circuit P is off in the period t1. Furthermore, a period tb after the first period t1 elapses is the light emission period in which the OLED element 130 of the pixel circuit P emits light. That is, the light emission control transistor 124 of the pixel circuit P is on in the period tb.

In the same manner, the light emission period and the non-light emission period are respectively provided below in the second period T2, the third period T3, and the fourth period T4. The non-light emission period in the second period T2, the third period T3, and the fourth period T4 are respectively a second period t2, a third period t3, and a fourth period t4. The relationship of the lengths of the non-light emission period from the first period T1 to a fourth period T4 are as follows.

$$t1>t2>t3>t4>$$

Figure 8:
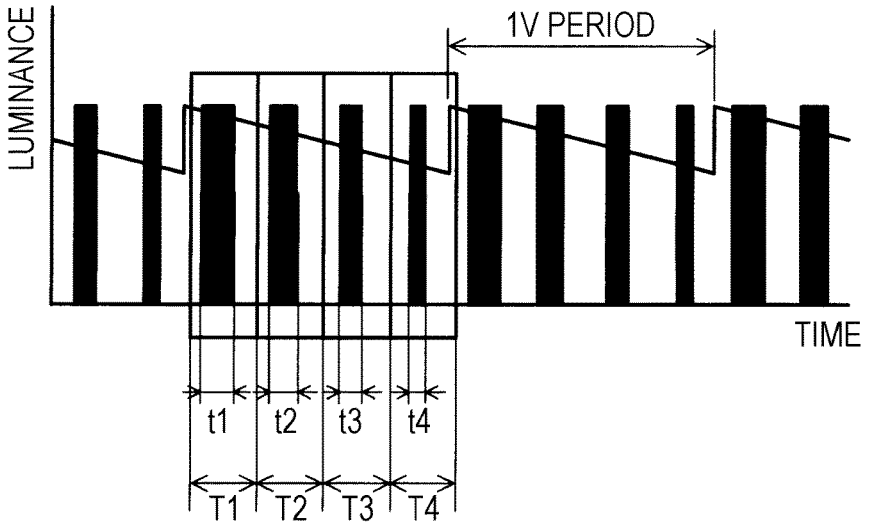
FIG. 8 is a diagram illustrating a relationship between the non-light emission period in each predetermined period and luminance in the first embodiment.

That is, as shown in FIG. 8, in the embodiment, the proportion of the non-light emission periods t1, t2, t3, and t4 in each predetermined period from the first period T1 to the fourth period T4 is monotonically decreased corresponding to the monotonic decrease of luminance in one frame period (1V period). In other words, the proportion of the light emission period in each predetermined period from the first period T1 to the fourth period T4 is monotonically increased. As a result, it is possible that luminance that is apparent in which the ratio of light emission period is multiplied by each predetermined period is averaged in the actual luminance and reduce the luminance difference of luminance that is apparent between the beginning and the end of one frame period. Accordingly, it is possible to reduce flicker.

In the embodiment, as shown in FIG. 2, since leakage current of the holding capacitor 132 is different according to a characteristic of individual holding capacitors 132, or a characteristic of individual display panels 2, it is possible to provide an adjustment portion 26 and adjust the length of the non-light emission period. The adjustment portion 26 is connected to volume and the like that is provided in the display panel 2, or is connected to the control circuit 25.

When the display panel 2 is adjusted, the image of a predetermined tone is displayed on the display panel 2, and a user operates the volume or the like while confirming the image that is displayed on the display panel 2. For example, in a case where the volume or the like is operated in a direction in which the length of the non-light emission period is increased, the adjustment portion 26 increases the length of the non-light emission period t1. The control circuit 25 determines the other non-light emission periods t2, t3, and t4 with reference to the length of the non-light emission period t1 that is set by the adjustment portion 26. In this case, the proportion of non-light emission periods t1, t2, t3, and t4 is monotonically decreased in each predetermined period from the first period T1 to the fourth period T4.

In this manner, in the embodiment it is possible to adjust the length of the non-light emission period while confirming a flicker state of the display panel 2. Accordingly, even in a case where characteristics of individual first holding capacitors 132 or characteristics of individual display panels 2 are different, it is possible to appropriately reduce flicker.

B: Second Embodiment

Figure 9:
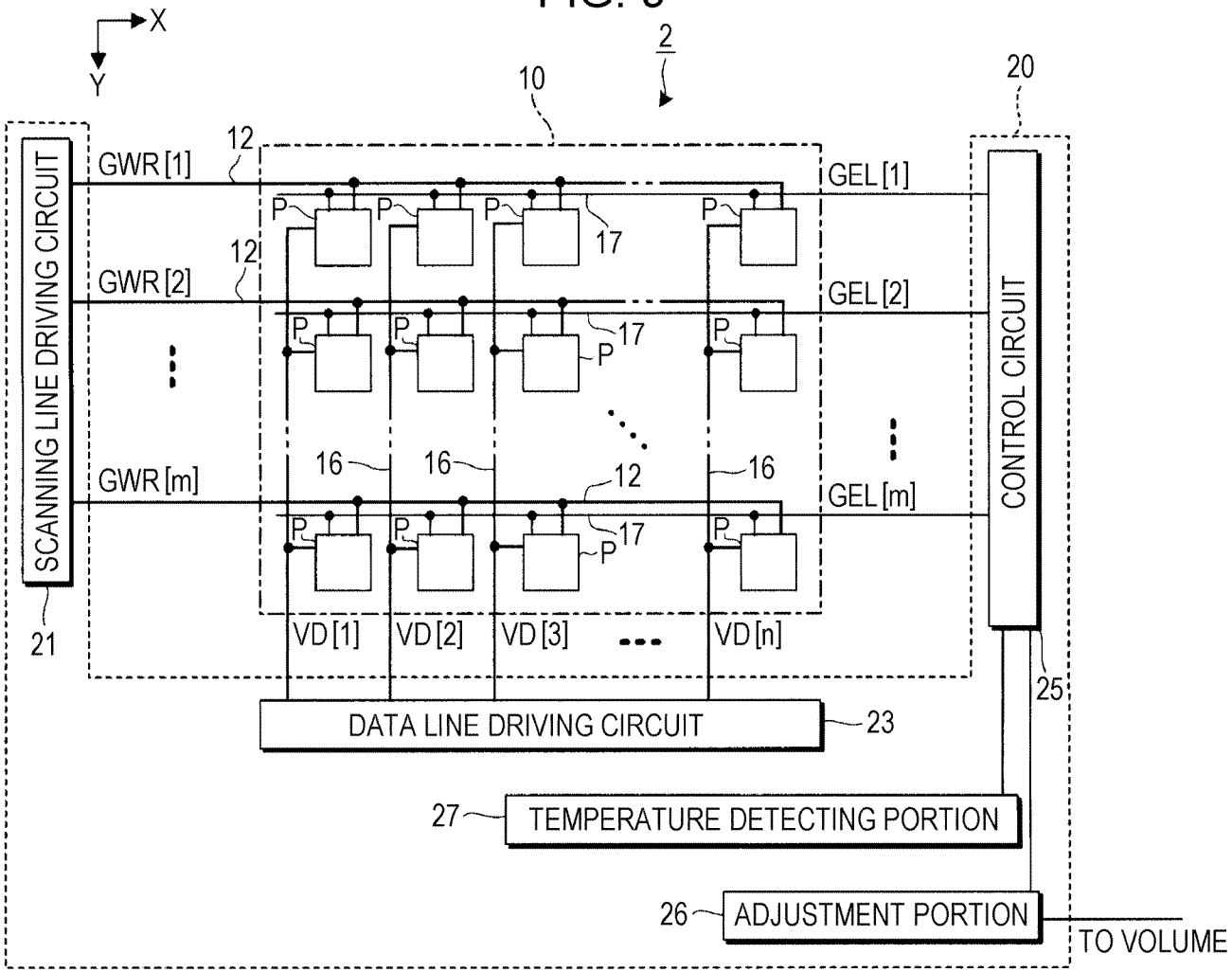
FIG. 9 is a block diagram of a display panel in an electro-optical device according to a second embodiment of the invention.

A second embodiment of the invention will be described with reference to the drawings. FIG. 9 is a block diagram illustrating a schematic configuration of the display panel 2 in the second embodiment. As shown in FIG. 9, in the embodiment, a temperature detecting portion 27 is provided that detects the temperature of the pixel circuit P. The temperature detecting portion 27 is connected to the control circuit 25. The control circuit 25 determines the length of the non-light emission period t1 according to the temperature that is detected by the temperature detecting portion 27, and determines the other non-light emission periods t2, t3, and t4 with reference to the length of the non-light emission period t1. In this case, the proportion of non-light emission periods t1, t2, t3, and t4 is monotonically decreased in each predetermined period from the first period T1 to the fourth period T4.

The leakage current from the holding capacitor 132 is considered to increase as the temperature increases. Therefore, in the embodiment, the temperature of the display panel 2 that includes the pixel circuit P is detected by the temperature detecting portion 27, and the control circuit 25 determines the length of the non-light emission period according to the detected temperature. For example, in a case where the detected temperature exceeds the predetermined temperature, the length of the non-light emission period is increased more than the initial value. As a result, it is possible to average luminance that is apparent per unit time and it is possible to reduce flicker according to the leakage current from the holding capacitor 132.

As above, according to the embodiment, even if the temperature is changed, it is possible to appropriately reduce flicker.

C: Modification Examples

The invention is not limited to the embodiments described above and, for example, the following modifications are possible. In addition, it is also possible to combine two or more modification examples out of the modification examples shown below.

Modification Example 1

In the embodiments described above, the driving transistor 121 and the selection transistor 122 in the pixel circuit P are unified in a P channel type, but may be unified in an N channel type. In addition, the P channel type and the N channel type may be appropriately combined.

Figure 10:
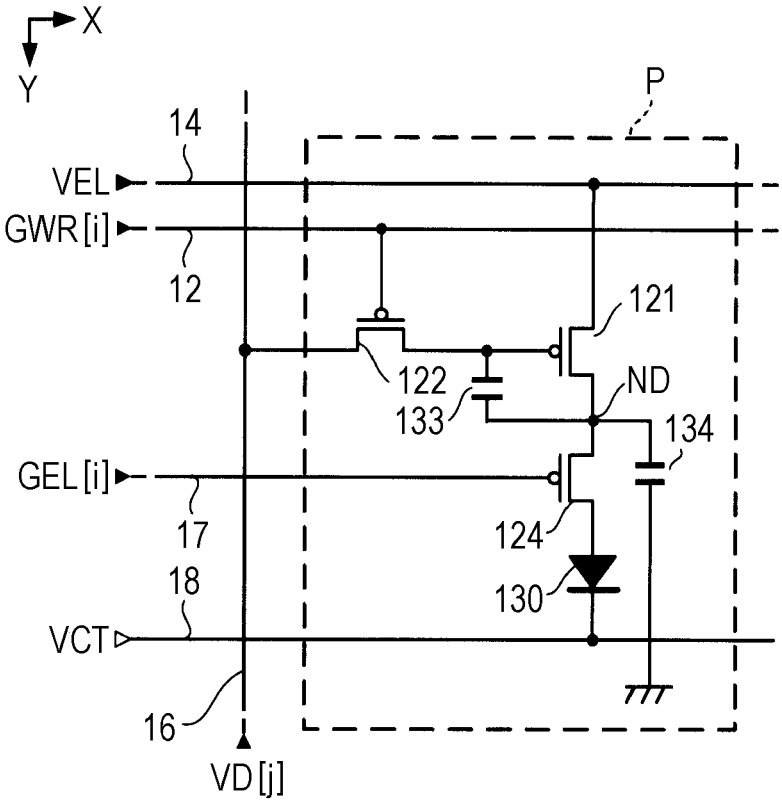
FIG. 10 is a circuit diagram of a pixel circuit according to a modification example of the invention.

FIG. 10 is an example in which the driving transistor 121 and the selection transistor 122 are unified in the N channel type. In this case, a holding capacitor 133 is provided that is connected between the gate of the driving transistor 121 and a connection node ND of the driving transistor 121 and the light emission control transistor 124. In addition, a holding capacitor 134 is provided that is connected between the connection node ND and the power supply line to which the ground potential is supplied.

In a case where each transistor is unified in the N channel type, a voltage at which positive and negative of the data signal VD[n] in the embodiments described above are reversed may be supplied to each pixel circuit P. In addition, in this case, the source and the drain of each transistor have a relationship that is reverse to the embodiments described above.

Note that, in the embodiments and the modification example described above, each transistor is a MOS type transistor, but may be a thin film transistor.

Modification Example 2

The light emitting element may be an OLED element, and may be an inorganic light emitting diode or a light emitting diode (LED). In short, it is possible to utilize an entire element that emits light according to supply of electric energy (application of electric field and supply of current) as the light emitting element of the invention.

Modification Example 3

In the embodiments described above, the non-light emission period of the OLED element 130 is provided by switching off the light emission control transistor 124. However, the invention is not limited to the configuration in this manner, but even in the pixel circuit P in which the light emission control transistor 124 is not provided, it is possible to provide the non-light emission period of the OLED element 130.

Figure 11:
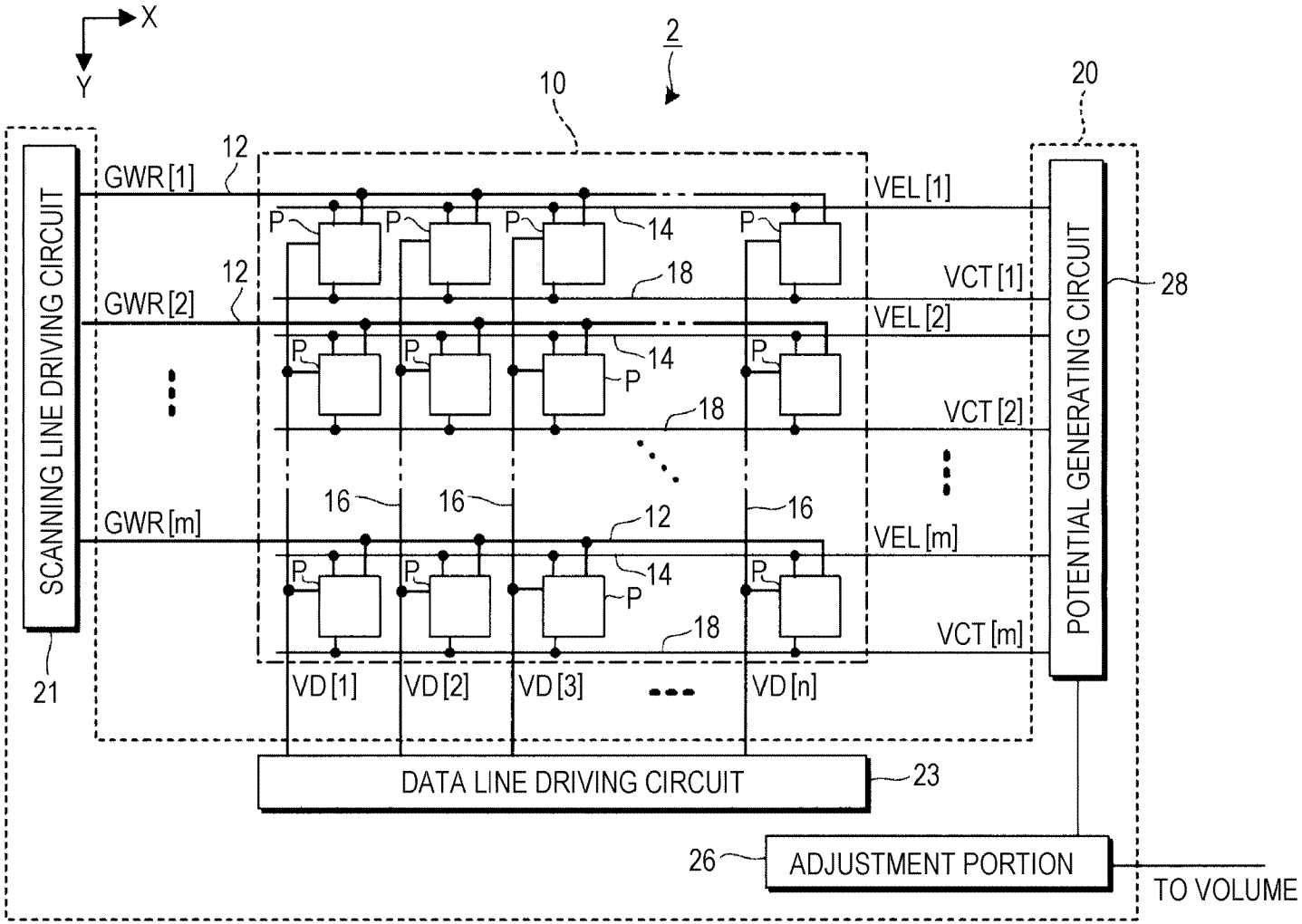
FIG. 11 is a block diagram of a display panel in the modification example.

FIG. 11 is a block diagram illustrating a schematic configuration of the display panel 2 in the modification example. As shown in FIG. 11, the display panel 2 of the modification example is provided with a potential generating circuit 28 in place of the control circuit 25.

The potential generating circuit 28 generates a power source voltage VEL on a high potential side and a power source voltage VCT on a low potential side. The potential generating circuit 28 outputs the power source voltage VEL on the high potential side to each first power supply line 14 in the light emission period of the OLED element 130. In addition, the potential generating circuit 28 outputs the power source voltage VCT on the low potential side to each first power supply line 14 in the non-light emission period of the OLED element 130. Furthermore, the potential generating circuit 28 outputs the power source voltage VCT to each second power supply line 18 in the light emission period and the non-light emission period of the OLED element 130.

Figure 12:
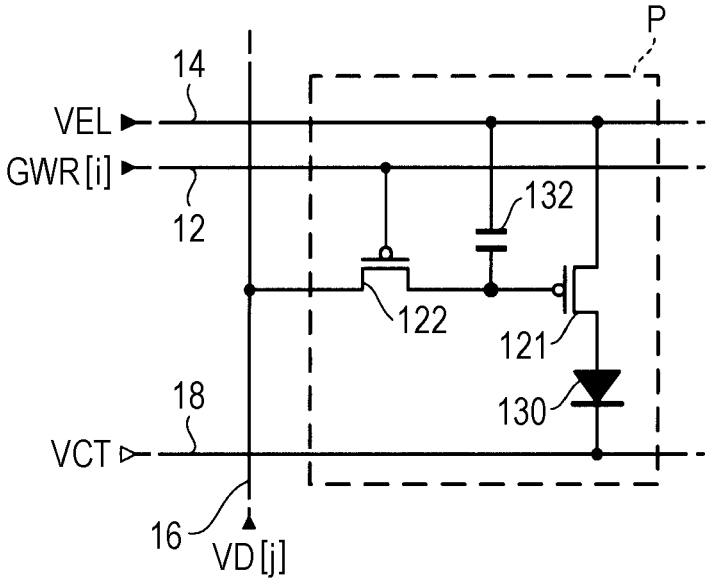
FIG. 12 is a circuit diagram of a pixel circuit in the modification example.

FIG. 12 is a circuit diagram of the pixel circuit P in the modification example. Since the pixel circuits P have the same electrical configuration as each other, here, the pixel circuit P that is positioned at m rows and n columns is described as an example. As shown in FIG. 12, the pixel circuit P is provided with the P channel MOS type driving transistor 121, the selection transistor 122 as a P channel MOS type switching element, the OLED element 130, and the holding capacitor 132. The pixel circuit P in the modification example is not provided with the light emission control transistor 124.

In the modified example, in the writing period in the horizontal scanning period in which the scanning line driving circuit 21 scans the scanning line 12 of the $m^{th}$ row, the selection transistor 122 is set to on, and the data signal VD[n] that is image data is output to the gate node of the driving transistor 121.

In addition, the potential generating circuit 28 outputs the power source voltage VEL on the high potential side to each first power supply line 14. After that, when the selection transistor 122 is set to off, the potential of the gate node of the driving transistor 121 is maintained at a potential that is indicated in the data signal VD[n] by the holding capacitor 132. Accordingly, the current is supplied according to the potential between the gate and source of the driving transistor 121. The OLED element 130 emits light according to the supplied current. That is, a period in which the potential generating circuit 28 outputs the power source voltage VEL on the high potential side to each first power supply line 14 is the light emission period of the OLED element 130. In the light emission period, the OLED element 130 displays the tone that is specified in the data signal VD[n].

Note that, as the holding capacitor 132, a capacitor that is parasitic on the gate node of the driving transistor 121 may be used, and a capacitor that is formed by interposing an insulation layer with conductive layers that are different from each other on the silicon substrate may be used.

Meanwhile, when the potential generating circuit 28 outputs the power source voltage VCT on the low potential side in each first power supply line 14, the current from the driving transistor 121 is not supplied to the OLED element 130, and the OLED element 130 is set to a non-light emission state. That is, a period in which the potential generating circuit 28 outputs the power source voltage VCT on the low potential side to each first power supply line 14 is the non-light emission period of the OLED element 130.

In the modification example, there is a configuration in which the OLED element 130 does not emit light in the entire period of one frame, the light emission period and the non-light emission period are provided in the predetermined period by outputting the power source voltage VEL on the high potential side and the power source voltage VCT on the low potential side from the potential generating circuit 28 to the first power supply line 14, and the proportion of the light emission period in the predetermined period is monotonically increased corresponding to monotonic decrease of luminance. In other words, there is a configuration in which the proportion of the non-light emission period in the predetermined period is monotonically decreased.

In the modification example, as shown in FIG. 11, it is possible to provide the adjustment portion 26 and adjust the length of the non-light emission period. The adjustment portion 26 is connected to volume and the like that is provided in the display panel 2, or is connected to the potential generating circuit 28.

When the display panel 2 is adjusted, the image of a predetermined tone is displayed on the display panel 2, and a user operates the volume or the like while confirming the image that is displayed on the display panel 2. For example, in a case where the volume or the like is operated in a direction in which the length of the non-light emission period is increased, the adjustment portion 26 increases the length of the non-light emission period. A period is increased in which the potential generating circuit 28 outputs the power source voltage VCT on the low potential side to the first power supply line 14 according to the signal from the adjustment portion 26. For example, as shown in FIG. 7, the potential generating circuit 28 monotonically decreases the proportion of the other non-light emission periods t2, t3, and t4 in each predetermined period from the first period T1 to the fourth period T4 with reference to the length of the non-light emission period t1 that is set by the adjustment portion 26.

In this manner, in the modification example, it is possible to adjust the length of the non-light emission period while confirming the flicker state of the display panel 2 by adjusting the period in which the power source voltage VCT on the low potential side from the potential generating circuit 28 is output to the first power supply line 14. Accordingly, even in a case where characteristics of individual first holding capacitors 132 or characteristics of individual display panels 2 are different, it is possible to appropriately reduce flicker.

D: Application Example

Figure 13:
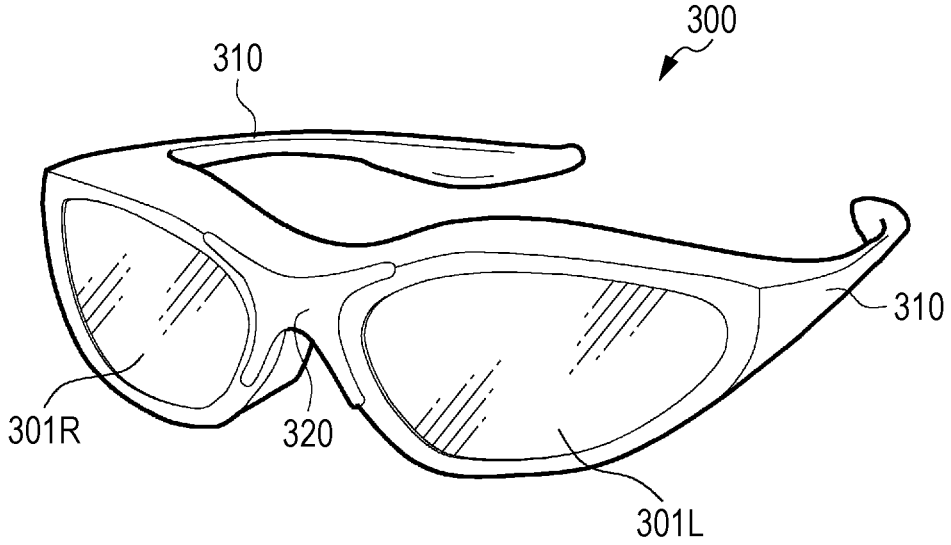
FIG. 13 is a perspective view illustrating a specific aspect of an electronic apparatus according to the invention.
Figure 14:
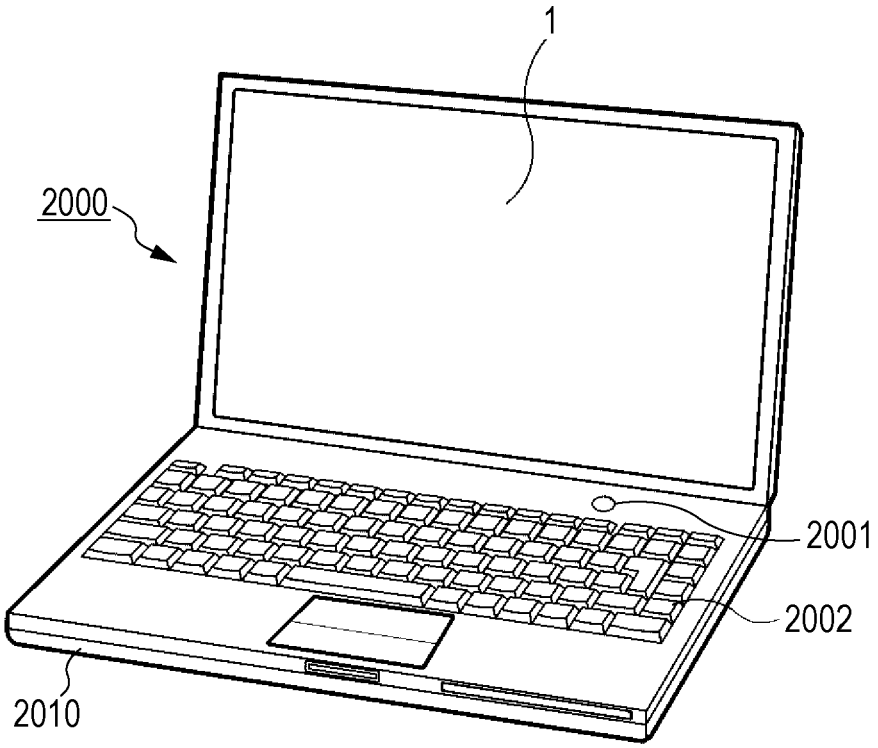
FIG. 14 is a perspective view illustrating a specific aspect of the electronic apparatus according to the invention.
Figure 15:
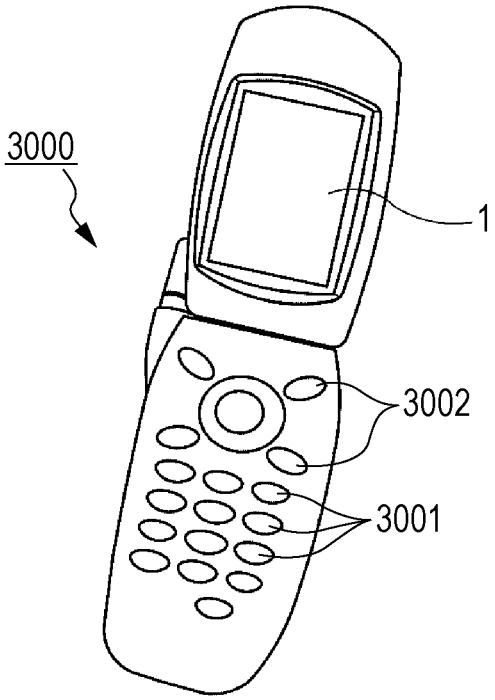
FIG. 15 is a perspective view illustrating a specific aspect of the electronic apparatus according to the invention.

It is possible to utilize the invention in various electronic apparatuses. FIGS. 13 to 15 exemplify a specific aspect of the electronic apparatus that is an application target of the invention.

FIG. 13 is a schematic view illustrating an outer appearance of a head mounted display as an electronic apparatus that adopts the electro-optical device of the invention. As shown in FIG. 13, in outer appearance, a head mounted display 300 has a temple 310, a bridge 320, and projection optical systems 301L and 301R in the same manner as general glasses. Although illustration is omitted, the electro-optical device 1 for the left eye and the electro-optical device 1 for the right eye are provided on the far side of the projection optical systems 301L and 301R in the vicinity of the bridge 320.

FIG. 14 is a perspective view of a portable personal computer to which the electro-optical device is adopted. A personal computer 2000 is equipped with the electro-optical device 1 that displays various images and a main body portion 2010 on which a power source switch 2001 or a keyboard 2002 are installed.

FIG. 15 is a perspective view of a mobile phone. A mobile phone 3000 is provided with a plurality of operation buttons 3001 or scroll buttons 3002, and the electro-optical device 1 that displays various images. A screen that is displayed on the electro-optical device 1 is scrolled by operating the scroll buttons 3002. The invention is able to be applied to such a mobile phone.

Note that, other than the devices exemplified in FIGS. 13 to 15, a mobile information terminal (personal digital assistant (PDA)) is given as the electronic apparatus to which the invention is applied. In addition, a digital still camera, a television, a video camera, a car navigation device, an in-vehicle display device (instrument panel), an electronic notebook, electronic paper, an electronic calculator, a word processor, a workstation, a video phone, and a POS terminal are given as examples. Furthermore, a printer, a scanner, a copier, a video player, a device that is provided with a touch panel, and the like are given as examples.

The entire disclosure of Japanese Patent Application No. 2016-124228, Jun. 23, 2016 is expressly incorporated by reference herein.

What is claimed is:

1. An electro-optical device comprising:

a first conductive layer that extends in a first direction;

a second conductive layer that extends in a second direction that intersects with the first direction;

a pixel circuit that is arranged at an intersection of the first conductive layer and the second conductive layer; and a driving circuit that drives the pixel circuit, wherein the pixel circuit includes:

a light emitting element in which one end is connected to a second power source layer, a driving transistor in which one of a source or a drain is connected to a first power source layer, other of the source or the drain is connected to another end of the light emitting element, and generates a driving current with respect to the light emitting element, and a first holding capacitor in which one end is connected to a gate of the driving transistor, the other end is connected to the source or the drain of the driving transistor, and holds a potential that corresponds to a potential of a data signal of a designated tone, wherein the driving circuit is provided with a plurality of predetermined periods equally divided within a vertical scanning period, each of the plurality of predetermined periods including a light emission period and a non-light emission period, and each of the plurality of non-light emission periods in each subsequent predetermined period is monotonically decreased, and wherein the driving circuit is provided with an adjustment portion that adjusts a length of the non-light emission period in the predetermined period according to an operation of a user.

2. The electro-optical device comprising:

a first conductive layer that extends in a first direction;

a second conductive layer that extends in a second direction that intersects with the first direction;

a pixel circuit that is arranged at an intersection of the first conductive layer and the second conductive layer;

a driving circuit that drives the pixel circuit; and a temperature detecting portion that detects a temperature of the pixel circuit, wherein the pixel circuit includes:

a light emitting element in which one end is connected to a second power source layer, a driving transistor in which one of a source or a drain is connected to a first power source layer, other of the source or the drain is connected to another end of the light emitting element, and generates a driving current with respect to the light emitting element, and a first holding capacitor in which one end is connected to a gate of the driving transistor, the other end is connected to the source or the drain of the driving transistor, and holds a potential that corresponds to a potential of a data signal of a designated tone, wherein:

the driving circuit is provided with a plurality of predetermined periods equally divided within a vertical scanning period, each of the plurality of predetermined periods including a light emission period and a non-light emission period, and each of the plurality of non-light emission periods in each subsequent predetermined period is monotonically decreased, and the driving circuit changes a proportion of the non-light emission period in the predetermined period according to the temperature that is detected by the temperature detecting portion.

3. A driving method for an electro-optical device comprising:

a first conductive layer that extends in a first direction;

a second conductive layer that extends in a second direction that intersects with the first direction; and a pixel circuit that is arranged at an intersection of each of the first conductive layer and the second conductive layer, and a driving circuit that drives the pixel circuit, in which the pixel circuit includes:

a light emitting element in which one end is connected to a second power source layer, a driving transistor in which a source or a drain is connected to a first power source layer, a source or a drain other than the source or the drain that is connected to the first power source layer is connected to another end of the light emitting element, and generates a driving current with respect to the light emitting element, and a first holding capacitor in which one end is connected to a gate of the driving transistor, the other end is connected to the source or the drain of the driving transistor, and holds a potential that corresponds to a potential of a data signal of a designated tone, wherein a plurality of predetermined periods are equally divided within a vertical scanning period, each of the plurality of predetermined periods includes a light emission period and a non-light emission period, and each of the plurality of the non-light emission periods in each subsequent predetermined period is monotonically decreased, and wherein the driving circuit is provided with an adjustment portion that adjusts a length of the non-light emission period in the predetermined period according to an operation of a user.

4. An electronic apparatus comprising:

the electro-optical device according to claim 1.

5. An electronic apparatus comprising:

the electro-optical device according to claim 2.

* * * * *